United States Patent [19]

Tax et al.

[11] 3,998,336

[45] Dec. 21, 1976

[54] CRANE WITH COMPENSATING COUNTERWEIGHT

[75] Inventors: Hans Tax, Munich; Klaus Hosler, Eichenau, both of Germany

[73] Assignee: Hans Tax, Munich, Germany

[22] Filed: Sept. 18, 1975

[21] Appl. No.: 614,355

[30] Foreign Application Priority Data

Sept. 27, 1974 Germany ..... 2446358

[52] U.S. Cl. ..... 212/48; 212/8 R; 212/58 R; 214/127; 214/142

[51] Int. Cl.[2] ..... B66C 23/72

[58] Field of Search ..... 214/142, 127; 212/48, 212/49, 8 R, 58 R

[56] References Cited

UNITED STATES PATENTS

| | | | |
|---|---|---|---|
| 3,517,829 | 6/1970 | Tax | 212/48 X |
| 3,653,486 | 4/1972 | McLean et al. | 214/142 |

FOREIGN PATENTS OR APPLICATIONS

| | | | |
|---|---|---|---|
| 575,328 | 5/1933 | Germany | |
| 103,945 | 3/1942 | Sweden | 212/48 |
| 117,783 | 2/1947 | Sweden | 212/48 |
| 132,787 | 10/1960 | U.S.S.R. | 212/48 |
| 303,280 | 5/1970 | U.S.S.R. | 212/8 R |

*Primary Examiner*—Othell M. Simpson
*Assistant Examiner*—W. R. Briggs
*Attorney, Agent, or Firm*—Hans Berman

[57] ABSTRACT

The weight of a pivotally mounted boom in a crane is compensated for in part by a counterweight which is suspended from one end of a compensating cable trained over a deflecting pulley at the top of the supporting crane structure. The other end of the cable is connected to a first fastener near the pivot axis of the boom by a rod and to another fastener on the boom remote from the pivot axis by a flexible chain. The rod is shorter than the distance between the first fastener and the deflecting pulley so that the compensating cable and the rod are longitudinally aligned before the boom reaches its steepest position, the boom thereby being relieved from the then unnecessary action of the counterweight.

9 Claims, 2 Drawing Figures

CRANE WITH COMPENSATING COUNTERWEIGHT

This invention relates to cranes equipped with a boom mounted on supporting structure for angular movement about an approximately horizontal axis, and more particularly to a crane equipped with a counterweight compensating for the weight of the boom.

In cranes whose booms may be swung about an approximately horizontal pivot axis on the supporting structure, it is common practice to provide a counterweight for relieving the boom swinging mechanism of at least a major portion of the boom weight. The force required for balancing the boom is proportional to the horizontal distance between the center of gravity of the boom and a vertical plane through the pivot axis and decreases as the boom swings upward from a horizontal position. When the counterweight is suspended from one end of a cable or rope trained over a deflecting pulley atop the crane, and the other end of the cable or rope is attached to a portion of the boom remote from the pivot axis, the counterweight provides a boom lifting force whose magnitude varies relatively little with the angular position of the boom.

To keep the boom under the control of the boom swinging mechanism at all times, it is necessary that the lifting torque exerted by the counterweight always be smaller than the torque of gravity acting on the boom. The counterweight, for this reason, can compensate for only a small portion of the boom weight in the horizontal boom position unless measures are taken for varying the effect of the counterweight with varying angular positions of the boom.

It was proposed heretofore to employ a counterweight consisting of several parts and to arrange stops along the path of the counterweight which remove portions of the counterweight from the supporting cable or rope as the counterweight descends during upward movement of the beam and return the removed portions during downward movement of the boom. The resulting sudden changes in the force exerted by the counterweight were found significantly to shorten the life of the various ropes and pulleys which support the boom and a load hanging from the boom.

To avoid the shocks inherent in this arrangement, it has been proposed to provide a spring which opposes the downward movement of the counterweight with increasing force as the boom approaches its highest or steepest position. Under unfavorable conditions, the spring may initiate deleterious oscillations of the boom.

The most successful known arrangement for adapting the force of the counterweight to the angular position of the boom provides a guide track for the counterweight whose slope decreases as the counterweight descends. The cost of building the necessary devices and for maintaining them in good operating condition is relatively high.

A crane in which the force of gravity acting on a counterweight is converted to gradually varying torque applied to the boom has been described in German Pat. No. 575,328, issued on May 15, 1933. Two rigid rods are connected to each other and to longitudinally spaced portions of the boom in a triangular configuration. The corner of the triangle defined by the two rods is connected to the counterweight and biased upward by the force of gravity acting on the counterweight. The corners of the triangle partly defined by the boom are both relatively far from the pivot axis of the boom so that the torque exerted by the counterweight tends to raise the boom from its lowermost position to an intermediate position and thereafter opposes further movement of the boom into its normal topmost position. The spacing of both rods from the boom pivot is necessary to accommodate the rigid rods in the space between the boom proper and the superstructure of the crane extending upward from the boom pivot. The lifting mechanism which raises and lowers the boom is rather complex and includes a second counterweight to offset the reversal of the torque exerted by the first counterweight in the intermediate angular position of the boom.

It is a primary object of the invention effectively to vary the torque exerted by a counterweight on a pivotally mounted boom by a simple device whose first cost is negligible as compared to the total cost of the crane, and which does not increase the cost of maintaining the crane.

With this object and others in view, the invention resides mainly in an improvement in a crane having a boom whose one longitudinally terminal portion is secured to a vertically extending support by a pivot having a substantially horizontal axis. A load may be suspended from the other terminal portion of the boom, and the crane is equipped with a mechanism for moving the boom about its pivot axis. The weight of the boom is at least partly compensated for by a counterweight mounted on the support for vertical movement.

The invention provides first and second elongated tension transmitting members having each a first and a second longitudinal end portion, at least the second tension transmitting member being pliable. A first securing arrangement closely adjacent the pivot axis of the boom secures the first end portion of the first tension transmitting member to the support. A second securing arrangement remote from the pivot axis secures the first end portion of the pliable second tension transmitting member to the other terminal portion of the boom, the second end portions of the two tension transmitting members being fastened to each other. A force transmitting arrangement is operatively interposed between the counterweight and the boom for exerting torque on the boom in response to force of gravity acting on the counterweight and includes an elongated force transmitting member attached to the fastened second end portions of the two tension transmitting members. A guide upwardly spaced on the support from the pivot axis of the boom engages the force transmitting member which is connected to the counterweight for urging the fastened second end portions of the tension transmitting members toward the guide under the force of gravity acting on the counterweight.

Other features, additional objects, and many of the attendant advantages of this invention will readily be appreciated as the same becomes better understood from the following detailed description of preferred embodiments when considered in connection with the appended drawing in which.

Figure 1:
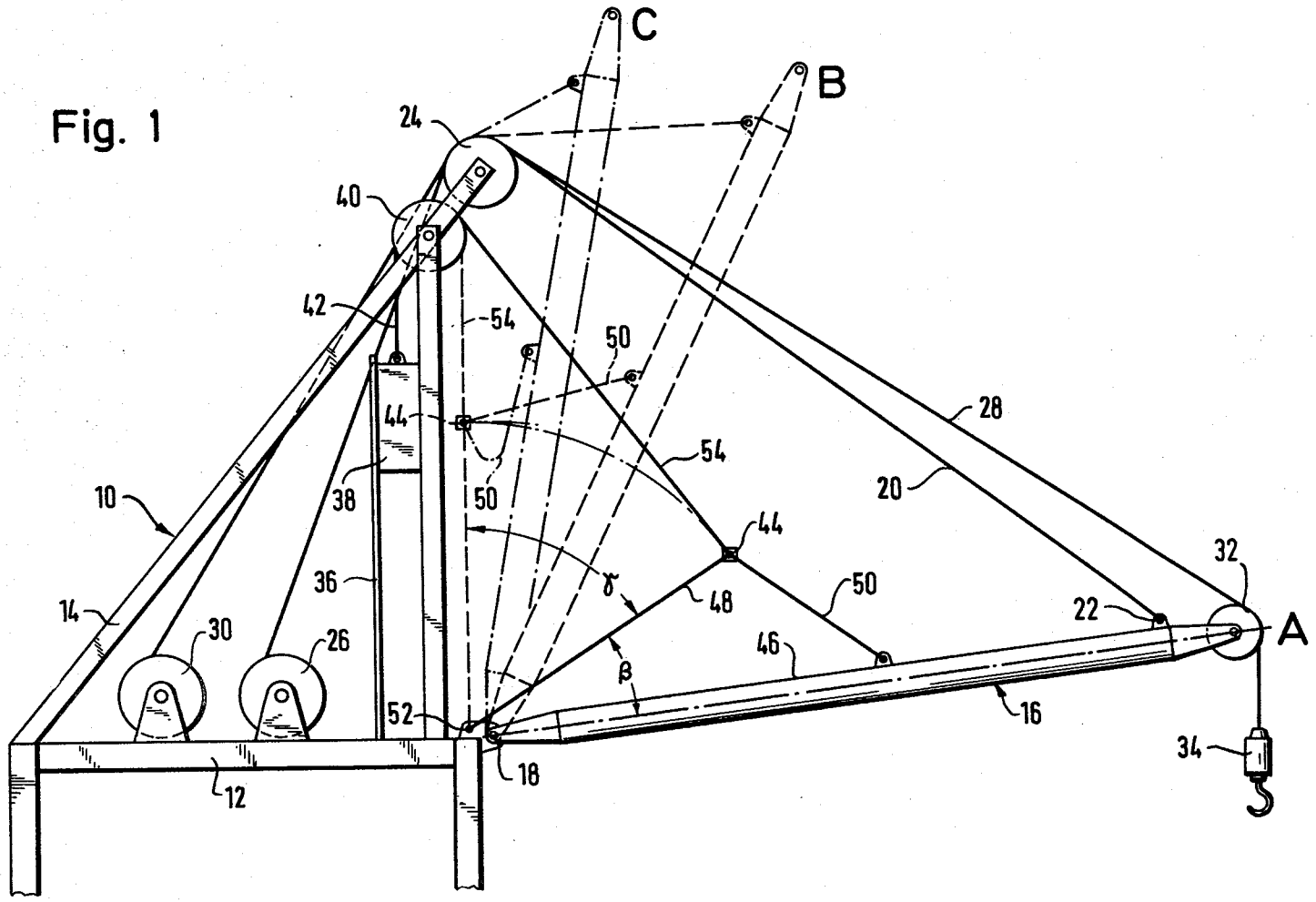
FIG. 1 shows a crane of the invention in simplified, fragmentary elevation.

Only as much of the vertically extending support structure 10 of a crane is shown in FIG. 1 as is needed for an understanding of the invention. The illustrated upper portion of the crane support includes a platform 12 and a rig 14 upwardly extending from the platform. One longitudinally terminal portion of a boom 16 is secured to the support 10 by a pivot 18 approximately on the level of the platform 12. The boom 16 may be swung about the substantially horizontal axis of the pivot 18 by a mechanism which includes a cable 20 attached near the free end of the boom 16 by a fastener 22, a deflecting pulley 24 atop the rig 14 and a motor-driven winch 26 on the platform 12. A load may be suspended from a pulley 32 at the free end of the boom 16, raised, or lowered by means of a cable 28 trained over a deflecting pulley coaxial with and obscured in the drawing by the pulley 24 and a winch 30 on the platform 12, the cable 28 being also trained over the pulley 32 and terminating in a hook 34.

Vertical guide rails 36 define the straight path of movement of a counterweight 38 which is suspended from yet another deflecting guide pulley 40 atop the rig 14 by one end portion 42 of a force transmitting cable. The other end portion 54 of the cable is attached to a connector 44 at the apex of a triangle defined by a section 46 of the boom 16 extending outward from the pivot 18, a steel rod 48, and a link chain 50. Respective ends of the rod 48 and of the chain 50 are fastened to each other by the connector 44. A fastener 52 secures the other end of the rod 48 to the rig 14 contiguously adjacent the pivot 18 while a similar fastener secures the other end of the chain 50 to a portion of the boom 16 remote from the pivot axis.

When the boom 16 is raised from the position A shown in fully drawn lines through an intermediate position B shown in broken lines to its steepest or uppermost position C illustrated in chain-dotted lines, the counterweight 38 moves straight down along the guide rails 36 under the force of gravity while the connector 44 travels in a circular arc indicated by a chain-dotted line toward the guide pulley 40 until the connector reaches a position located on a straight line connecting the fastener 52 with the point of engagement of the cable portion 54 with the pulley 40. This line indicates the location of the rod 48 and of the cable portion 54 reached when the boom 16 has been raised to the position B by the winch 26. During subsequent lifting of the boom 16 from the position B to the position C, the pliable chain 50 is flexed in the plane of the drawing, but the connector 44 and the counterweight 38 stand still.

The arc through which the boom 16 approaches its topmost position C without being subjected to the weight compensating force of the counterweight 38 is determined by the length of the chain 50. The chain remains tensioned and transmits tension to the boom 16 during movement of the boom between positions A and B. If the chain 50 were longer, it would become slack before the position B is reached, and the chain would transmit tension to the boom 16 beyond position B if it were shorter.

The length of the rod 48 determines the rate at which the force exerted by the counterweight increases from a value of zero at boom position B as the boom 16 is lowered toward position A. The force increases more slowly and reaches a lower maximum value when the rod 48 is shorter. At any length of the rod 48, the force exerted by the counterweight 38 approaches zero gradually and at a steadily decreasing rate as the rod 48 and the cable portion 54 approach longitudinal alignment. There is no shock effect on the boom 16 and the associated cables and pulleys.

The rod 48 exerts only tension on the connector 44 and does not have to absorb compressive or bending stresses during movement of the boom 16 between the illustrated terminal positions A and C whose location is determined by the characteristics of the cable 20 and the winch 26. While it is preferred to employ a rigid rod between the connector 44 and the fastener 52 because of its virtually unlimited durability, a cable or rope or another chain may be substituted. For similar reasons, the chain 50 is preferred for transmitting tensional forces between the connector 44 and the boom 16, but a cable or rope may be substituted. A rod would not do because of its lack of flexibility.

The fastener 52 must be spaced from the engagement point of the pulley 40 a distance greater than the length of the rod 48. It is also desirable that it be offset downward from the connector 44 in all operative positions of the boom 16.

Figure 2:
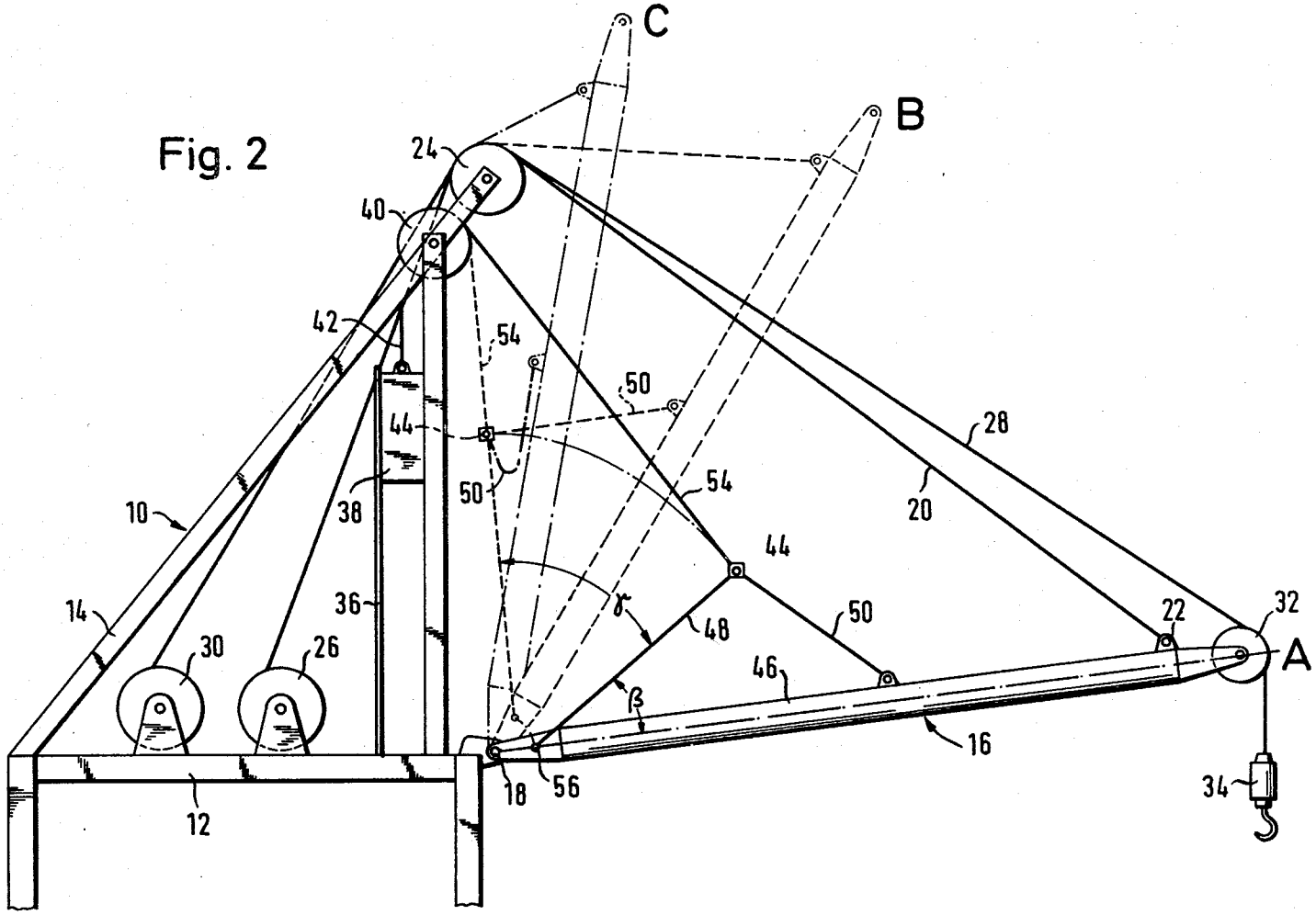
FIG. 2 illustrates a modification of the crane of FIG. 1 in a corresponding manner.

The rod 48 need not be secured directly to the rig portion 14 of the support 10 by the fastener 52, but may be attached to a portion of the boom 16 contiguously adjacent the pivot 18 in the manner illustrated in FIG. 2. The embodiment of the invention shown in FIG. 2 is identical with that described above with reference to FIG. 1 except for a fastener 56 which pivotally attaches the inner end of the rod 48 to the boom 16 closely adjacent the pivot 18.

The spacing of the pivot 18 from the fastener 56 which attaches the rod 48 to the boom 16 is important, and the advantages of the apparatus shown in FIG. 2 are largely lost if this spacing is greater than 10% of the effective length of the boom 16, as measured between the pivot 18 and the point of engagement between the suspension pulley 32 and the vertical, depending leg of the cable 28. The torque exerted by the counterweight 38 on the boom 16 in the intermediate position B becomes negligible if the spacing of the pivot 18 from the fastener 52 is no greater than 2% of the boom length, but a spacing of 5% of boom length is often tolerable.

The arrangement shown in FIG. 1 is generally preferred because it does not load the pivot 18 with the tensional forces transmitted by the rod 48 and thereby provides a longer maintenance-free life for the pivot under otherwise identical operating conditions.

In either embodiment of the invention, the cable portion 54 and the chain 50 define an obtuse angle of almost 180° in position A of the boom 16. The angle decreases gradually during upward swinging movement of the boom so that the chain 50 and the cable portion 54 define an angle of only about 75° in boom position B. If it is desired to make the tension transmitting member 48 longer or to swing the boom further down than is shown in the drawing, the angle shown as obtuse in position A may become greater than 180°. It would be necessary to replace the rigid rod 48 by a corresponding flexible member to permit such operation.

Other modifications of the illustrated apparatus will suggest themselves to those skilled in the art when the apparatus is to be adapted to special applications. It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the attendant claims.

What is claimed is:

1. A crane comprising:

a. a vertically extending support;

b. an elongated boom having two longitudinally terminal portions;

c. pivot means securing one of said terminal portions to said support for angular movement about a substantially horizontal axis;

d. suspending means for suspending a load from the other terminal portion of said boom;

e. moving means for moving said boom angularly about said pivot axis;

f. first and second elongated tension transmitting members having each a first and a second longitudinal end portion, said second tension transmitting member being pliable;

g. first securing means securing the first end portion of said first tension transmitting member to said support;

h. second securing means securing the first end portion of said second tension transmitting member to said boom at a point remote from said pivot means, the second end portions of said tension transmitting members being fastened to each other;

i. a counterweight mounted on said support for vertical movement;

j. force transmitting means operatively interposed between said counterweight and said boom for exerting torque on said boom in response to force of gravity acting on said counterweight, said force transmitting means including an elongated force transmitting member attached to said fastened second end portions; and k. guide means upwardly spaced on said support from said pivot axis and engaging said force transmitting member, said force transmitting member being connected to said counterweight for urging said fastened second end portions toward said guide means under said force of gravity.

2. A crane as set forth in claim 1, wherein the spacing of said guide means from said first securing means is greater than the length of said first tension transmitting member, and the combined length of said first and second tension transmitting members is greater than the spacing of said first and second securing means.

3. A crane as set forth in claim 1, wherein the spacing of said first securing means from said pivot axis is less than 10% of the spacing of said suspending means from said pivot axis.

4. A crane as set forth in claim 3, wherein said spacing of said first securing means is less than 5% of said spacing of said suspending means.

5. A crane as set forth in claim 3, wherein said spacing of said first securing means is not greater than 2% of said spacing of said suspending means.

6. A crane as set forth in claim 1, wherein said pivot means secure said one terminal portion to a portion of said support, said first securing means including a fastening member directly fastening said first end portion of the first tension transmitting member to said portion of said support.

7. A crane as set forth in claim 1, further comprising means limiting said angular movement of said boom to an angle between a lowermost position and a topmost position of said boom, said force transmitting member and said first tension transmitting member being longitudinally aligned in a position of said boom intermediate said lowermost and topmost positions, whereby said force transmitting member and said first tension transmitting member remain longitudinally aligned during movement of said boom from said intermediate toward said topmost position.

8. A crane as set forth in claim 7, wherein said fastened second end portions are offset upwardly from said pivot axis in all positions of said boom between said lowermost and uppermost positions.

9. A crane as set forth in claim 1, wherein said first end portions are spaced apart a distance smaller than the combined lengths of said tension transmitting members.

* * * * *